US005116034A

United States Patent [19]

Trask et al.

[11] Patent Number: 5,116,034

[45] Date of Patent: May 26, 1992

[54] ENVELOPE/SHEET FEED MECHANISM

[75] Inventors: Jeffrey L. Trask; George B. Clifton; Kenneth E. Heath, all of Boise, Id.

[73] Assignee: Hewlett-Packard Company, Palo Alto, Calif.

[21] Appl. No.: 627,787

[22] Filed: Dec. 14, 1990

[51] Int. Cl.[5] ..... B65H 3/44

[52] U.S. Cl. ..... 271/2; 271/9; 271/121; 271/122; 400/607; 400/629

[58] Field of Search ..... 271/2, 9, 121, 122; 400/605, 607, 607.1, 607.2, 608, 624, 625, 626, 629

[56] References Cited

U.S. PATENT DOCUMENTS 4,620,809 11/1986 Runzi ..... 400/624

4,662,765 5/1987 Kapp ..... 271/2 X 4,674,743 6/1987 Ibuchi ..... 271/9

*Primary Examiner*—Richard A. Schacher

[57] ABSTRACT

A mechanism is described for automatically handling envelopes and paper sheets, the mechanism having an input window for receiving the envelopes and paper sheets. The mechanism comprises a first tray for holding a stack of paper sheets and is mountable in the window. A second tray is provided for holding a stack of envelopes and is also mountable in the window. A roller system is positioned to selectively engage the topmost sheet of the stack of sheets in the first tray or a bottommost envelope of the stack of envelopes in the second tray and to feed either the topmost sheet or the bottommost envelope, as the case may be.

17 Claims, 9 Drawing Sheets

ENVELOPE/SHEET FEED MECHANISM

FIELD OF THE INVENTION

This invention relates to mechanisms for feeding paper sheets and envelopes, and more particularly, to an envelope/sheet feed mechanism for a printer.

BACKGROUND OF THE INVENTION

When modern electrophotographic printers were first introduced, substantial problems were experienced with the paper feed and handling mechanisms. Over the years, such mechanisms, especially those designed to handle flat sheet stock, have greatly improved and now provide reliable service. Such sheet feed mechanisms generally remove a single sheet from a stack by grabbing the topmost sheet and feeding it into the printer mechanism. Using a top feed system enables the user to add a single sheet to the stack and to have it fed upon the next print cycle. Thus, if it is desired to insert a letterhead sheet, it merely needs to be placed at the top of the stack. Were the sheets fed from the bottom, the insertion of a single sheet would be substantially more inconvenient.

Similar advances have not been experienced with envelope feeders. The thickness and shape of envelopes generally dictates that envelope feeders feed from the bottom of an envelope stack. This has prevented the integration of sheet/envelope feeders.

The prior art has approached the problem of envelope feeding mainly via two routes. The first required that all of the sheet stock be removed from the sheet feeder and a single envelope fed therethrough. Systems using this technique were generally unable to handle, automatically, a series of envelopes. The second required provision of an entirely separate envelope-feeding mechanism that was insertable into the printer body. Within the printer body there was a set of feed rolls which would grab the envelope and then feed it into the printer body. This latter technique required the addition of additional mechanisms and circuits to the printer, which often went unused if the user did not purchase an optional envelope feeder. This resulted in an increase in the cost of the printer to all customers, as it was uneconomical to manufacture a special printer, particularly for customers who wanted the optional envelope feeders.

Accordingly, it is an object of this invention to provide an improved, automatic, envelope/sheet feed mechanism.

It is another object of this invention to provide an improved envelope/sheet feed mechanism particularly adapted for inclusion in a non-impact printer.

It is still another object of this invention to provide a combined envelope/sheet feed mechanism which requires little modification to a printer already having the capability to top-feed sheets.

SUMMARY OF THE INVENTION

A mechanism is described for automatically handling envelopes and paper sheets, the mechanism having an input window for receiving the envelopes and paper sheets. The mechanism comprises a first tray for holding a stack of paper sheets which is mountable in the window. A second tray is provided for holding a stack of envelopes and is also mountable in the window. A roller system is positioned to selectively engage the topmost sheet of the stack of sheets in the first tray or the bottommost envelope of the stack of envelopes in the second tray, and to feed either the topmost sheet or the bottommost envelope, as the case may be.

DESCRIPTION OF THE INVENTION

Figure 1:
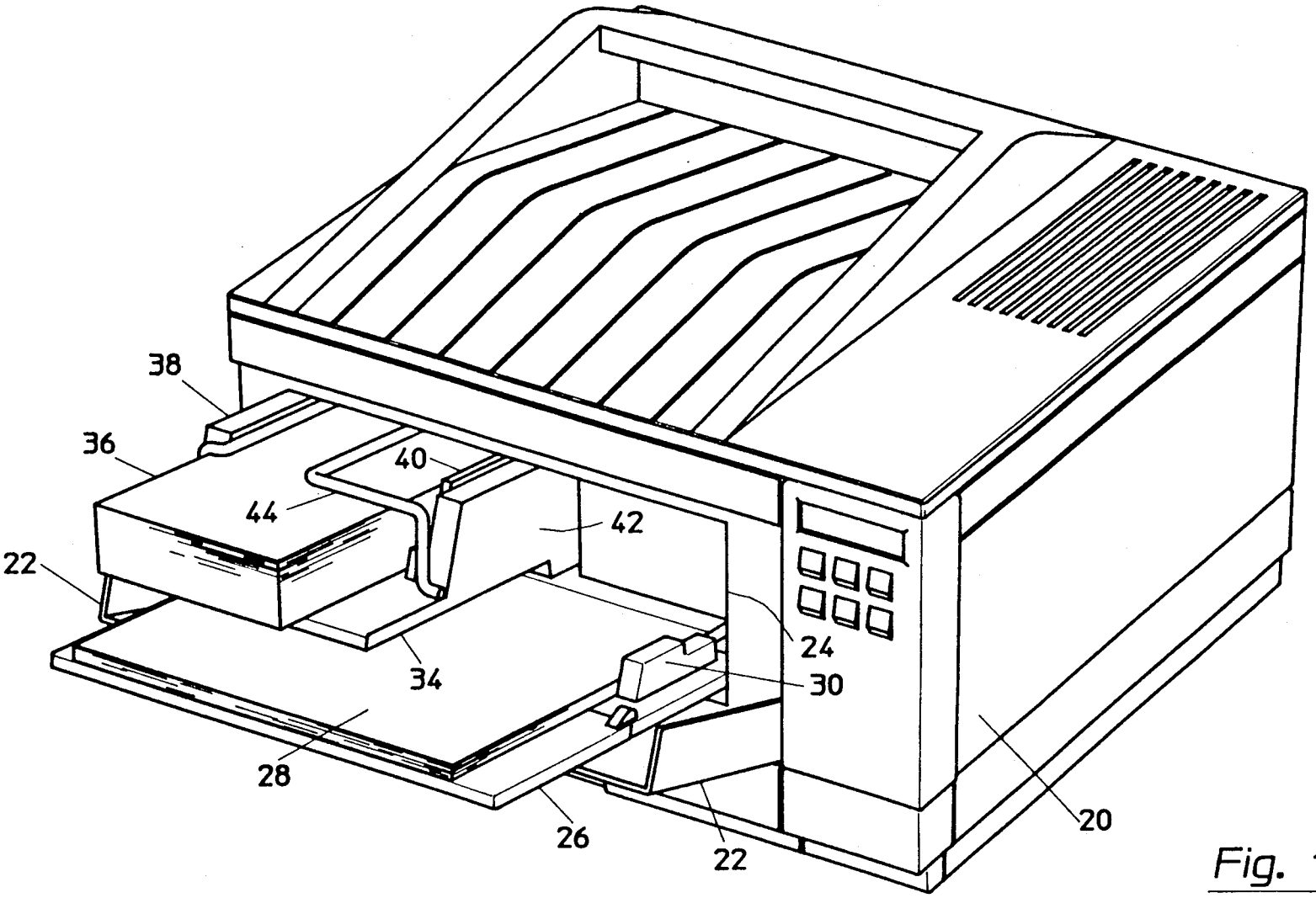
FIG. 1 is a front right perspective view of a printer having envelope and sheet feed mechanisms installed in a window thereof.

Referring now to FIG. 1, it is to be initially noted that the mechanisms shown therein are numbered identically in all of the FIGS. herein. Further, while paper sheet stock will be hereinafter referred to, it is to be understood that any sheet stock may be fed by this invention.

A printer case 20 houses a laser printer such as a LASERJET printer (a trademark of the Assignee hereof). Printer case 20 is provided with a front door 22 that swings down to expose a window 24. A two section paper sheet tray 26 is adapted to be unfolded outwardly when door 22 pivots downwardly. The configuration of FIG. 1 shows paper tray 26 after its two segments have been unfolded to create a planar paper tray. It should be noted that while paper tray 26 is shown as permanently attached in window 24, it may be replaced by a removable paper tray, if desired. A stack 28 of paper sheets is positioned on tray 26 and is restrained from lateral movement by a movable side guide 30 and a fixed side guide 32 (see FIG. 2).

Also positioned within window 24 is a removable envelope tray 34 that is shown with a stack 36 of envelopes. Stack 36 is maintained in place by a wall portion 38 of envelope tray 34 and by a movable guide 40, which is slidably mounted in wall portion 42 of envelope tray 34.

A wire weight 44 is pivotally mounted on envelope tray 34 and maintains envelope stack 36 in position. The operation of wire weight 44 can be better visualized by referring to FIG. 2 where envelope tray 34 has been removed from printer case 20. There, wire weight 44 is shown in two configurations, one where envelope stack 36 is in place and one where all envelopes have been fed (with wire weight being indicated by 44' in the latter configuration). It is to be noted that the end portion 46 of wire weight 44 is positioned directly over a feed roller 48 that engages the lowermost envelope in stack 36. By positioning weight 46 thereover, envelope stack 36 is compressed directly onto feed roller 48, thereby insuring improved feeding.

Figure 2:
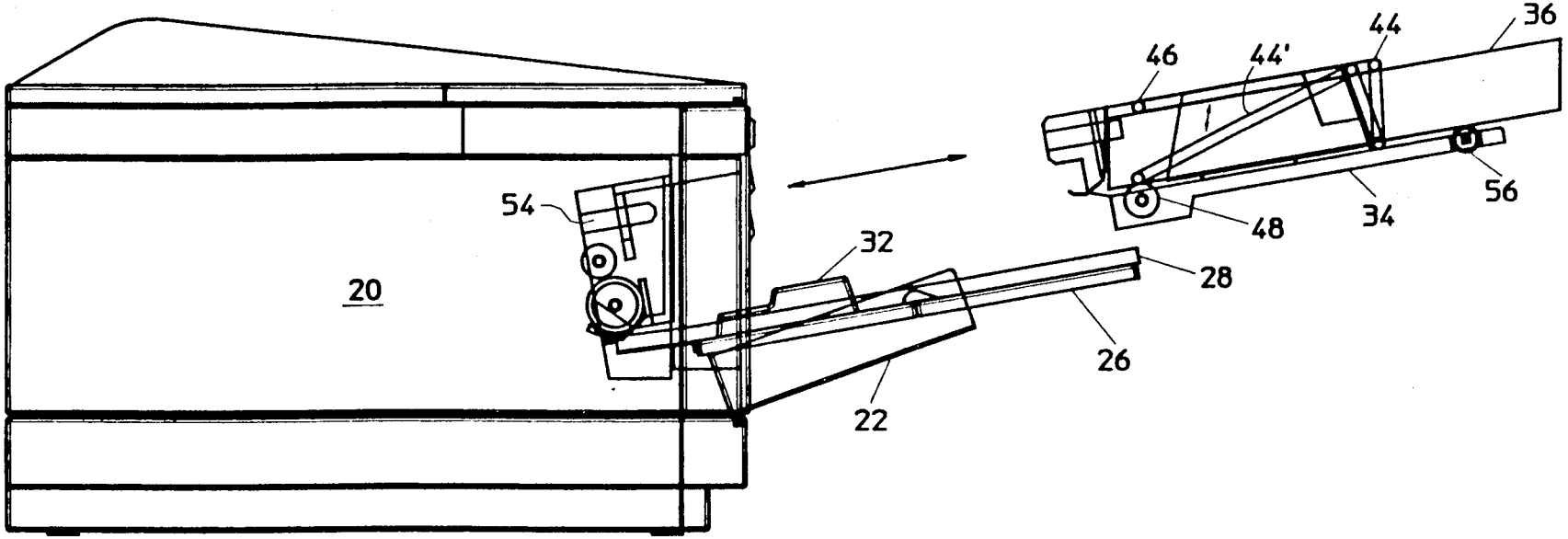
FIG. 2 is a schematic, left side, plan view of the printer showing the envelope feed disengaged from the printer.
Figure 3:
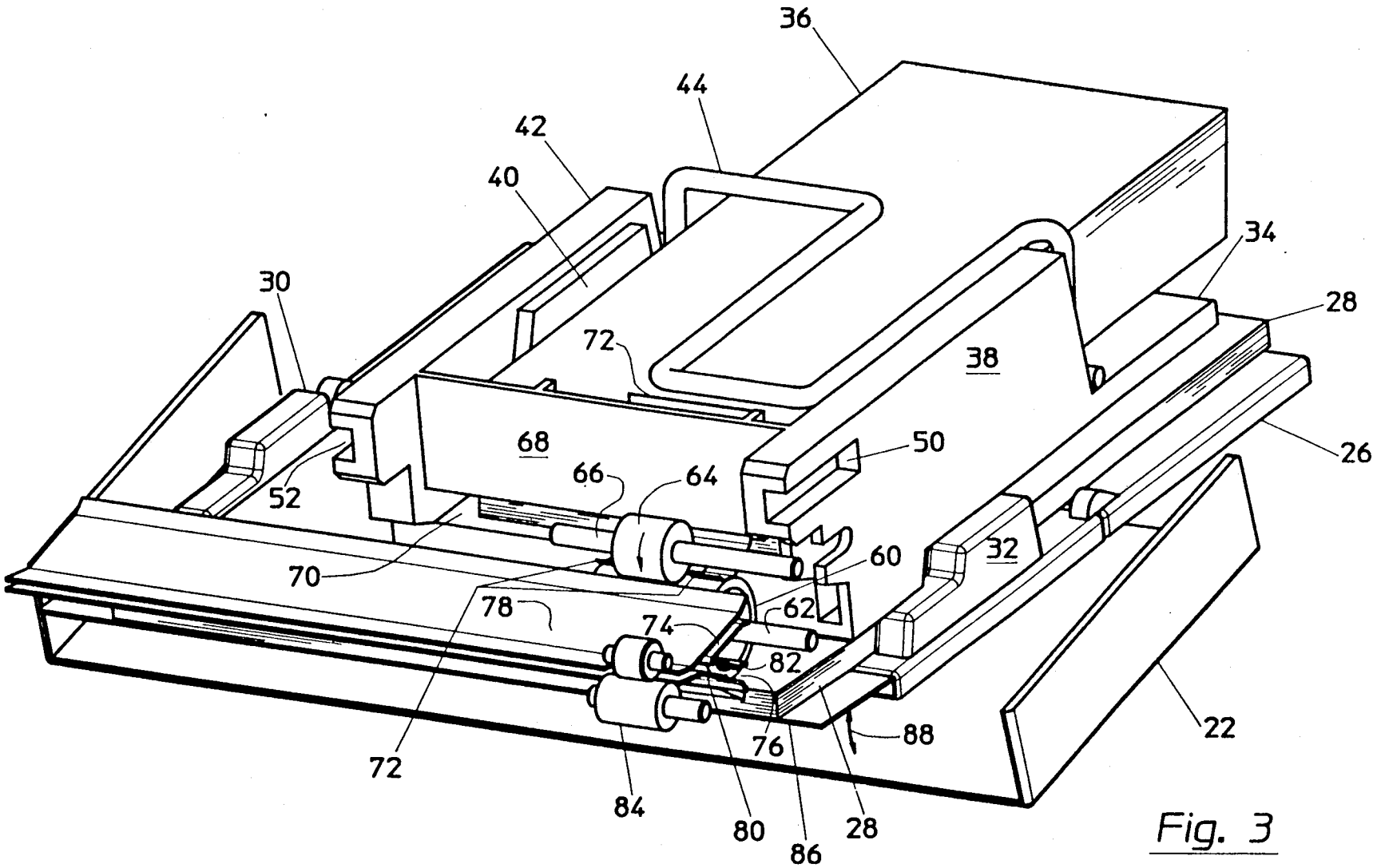
FIG. 3 is a left front perspective view of the envelope and sheet feed mechanisms in combination with certain portions of the printer feed mechanism.

Referring now to FIGS. 2 and 3 in combination, the outer surfaces of wall portions 38 and 40 of envelope tray 34 are provided with grooves 50 and 52 that engage with mating ridge projections 54 within printer case 20 (shown schematically in FIG. 2). The engagement between ridge projections 54 and grooves 50 and 52 enables envelope tray 34 to be slidably inserted and removed from printer case 20 and also supports envelope tray 34 when it is in place within the printer case. As is further shown in FIG. 2, envelope tray 34 further includes a free wheeling idler roller set 56 that engages the rear portion of the lowermost envelope in stack 36.

In FIG. 3, the relationship is illustrated between envelope tray 34, paper sheet tray 56 and the internal feed mechanism contained within the printer, when both trays 26 and 34 are in place within window 24. The remaining portions of the printer are not illustrated.

A central feed roll 60 (partially obscured) is mounted for rotation on shaft 62 which, in turn, is connected to a bidirectional feed drive, to be described below. A counter-rotating stripper roll 64 is mounted for rotation about shaft 66. Stripper roll 64 is preferably comprised of a sponge-type material which is both substantially pliable and compressible. Shaft 66 is fixedly mounted and causes stripper roller 64 to counter rotate against the direction of rotation of central feed roll 60, when an envelope is being fed from stack 36.

Central feed roll 60 is covered with a textured rubber surface that exhibits a coefficient of friction, preferably in the range of 1.5 to 2.0. Shaft 62 is rotatable in either the clockwise or counterclockwise direction, depending upon whether paper sheets or envelopes are to be fed.

An end wall 68 is disposed in envelope tray 34 between wall portions 38 and 42. End wall 68 terminates at its lowermost end, above the floor of tray 34 to leave an opening 70 for envelope feeding. A flexible guide 72 is mounted on the inner side of wall 68 and is provided with a pair of bent fingers that engage the outer periphery of central feed roll 60 when envelope tray 34 is in position. Fingers 72 are comprised of a pliant metal and force an envelope against the outer periphery of central feed roll 60. A space between fingers 72 accommodates stripper roll 64, so that it may function to prevent a double envelope feed.

Further interior to the printer, a pair of guide channels 74 and 76 are formed by sheet metal members 78, 80, and 82. Guide channel 74 feeds envelopes from central feed roll 60 to a pair of transport rollers 84, whereas guide channel 76 feeds paper sheets to transport rollers 84 as they are fed from the top of stack 28.

At the distal end of paper sheet tray 26, a lift plate 86 is positioned within the body of the printer. Lift plate 86 is movable vertically along the direction indicated by arrows 88 and is controlled in such movement by a spring/cam arrangement (not shown) which normally biases lift plate 86 in a lowermost position. When it is desired to feed the topmost sheet of paper from stack 28, a cam is actuated which acts against the lower surface of lift plate 86 and causes it to rise, thereby causing the uppermost sheet of paper on stack 28 to contact central feed roll 60 and to be fed thereby into guide channel 76.

Figure 4:
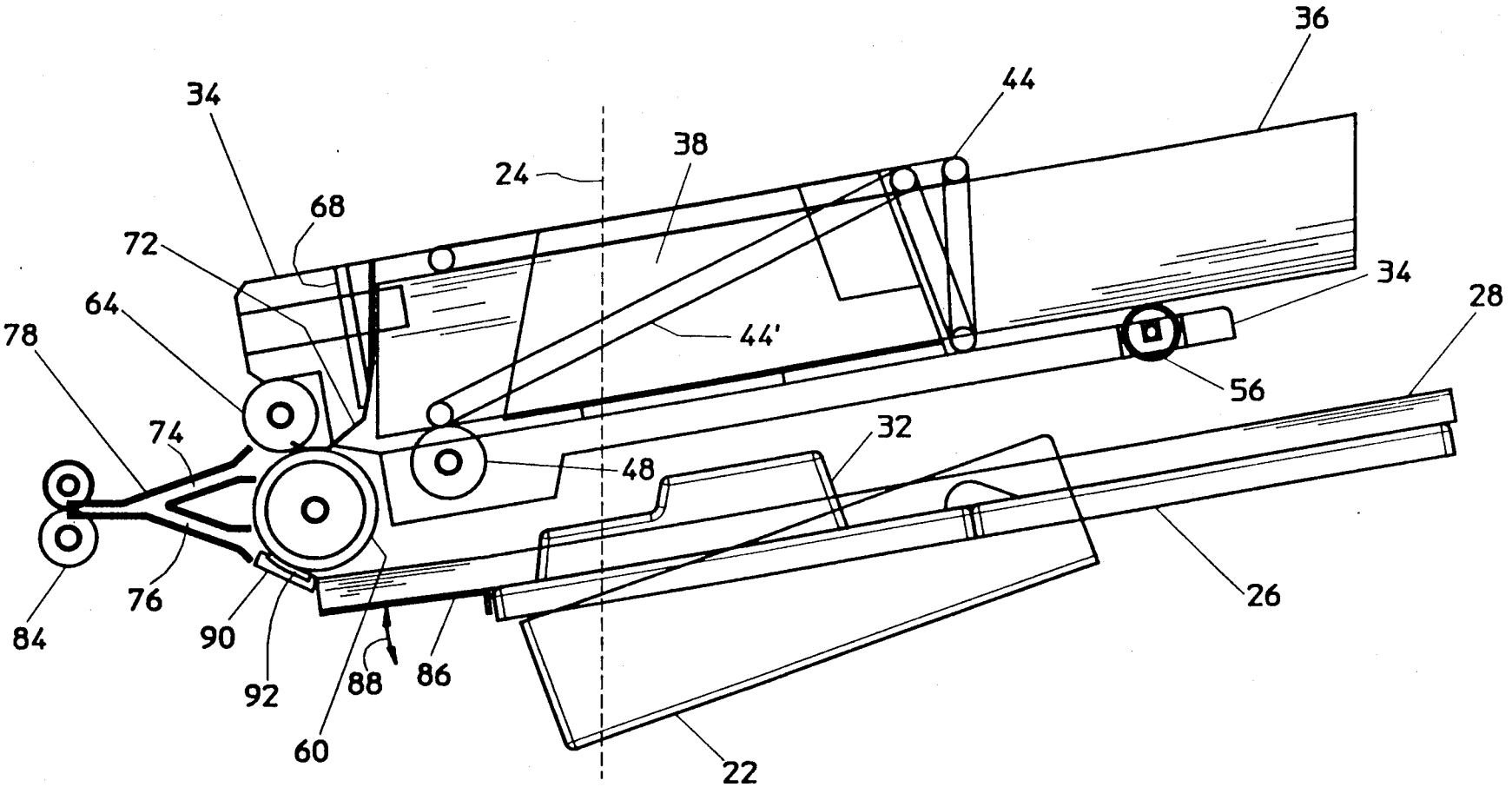
FIG. 4 is a schematic, left side, plan view of the mechanism shown in FIG. 3.

A schematic left plan view of the mechanism is shown in FIG. 4. A separation pad 90 contacts the outer periphery of central feed roll 60. Separation pad 90 is provided with a hard rubber insert 92 that exhibits a lower coefficient of friction (e.g., approximately 1.0) than the surface of roller 60. Since, however, its coefficient of friction is higher than that of a paper sheet, if two sheets are grabbed by roller 60, hard rubber insert 92 will prevent the lower sheet from being drawn into guide channel 76.

Figure 5:
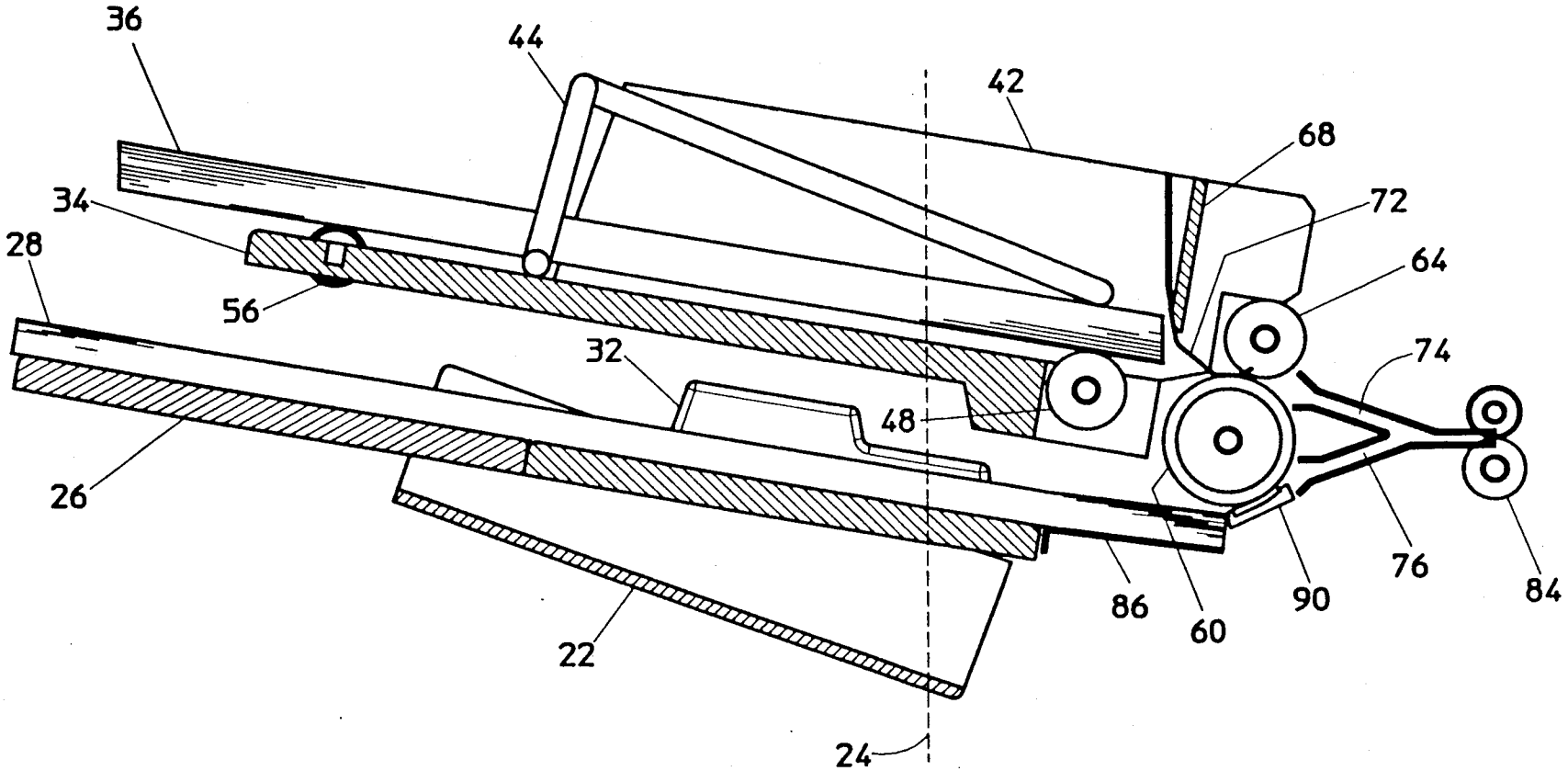
FIG. 5 is a right side, plan view of the mechanism of FIG. 3, with the side, sheet retainer and envelope tray side wall removed.
Figure 6:
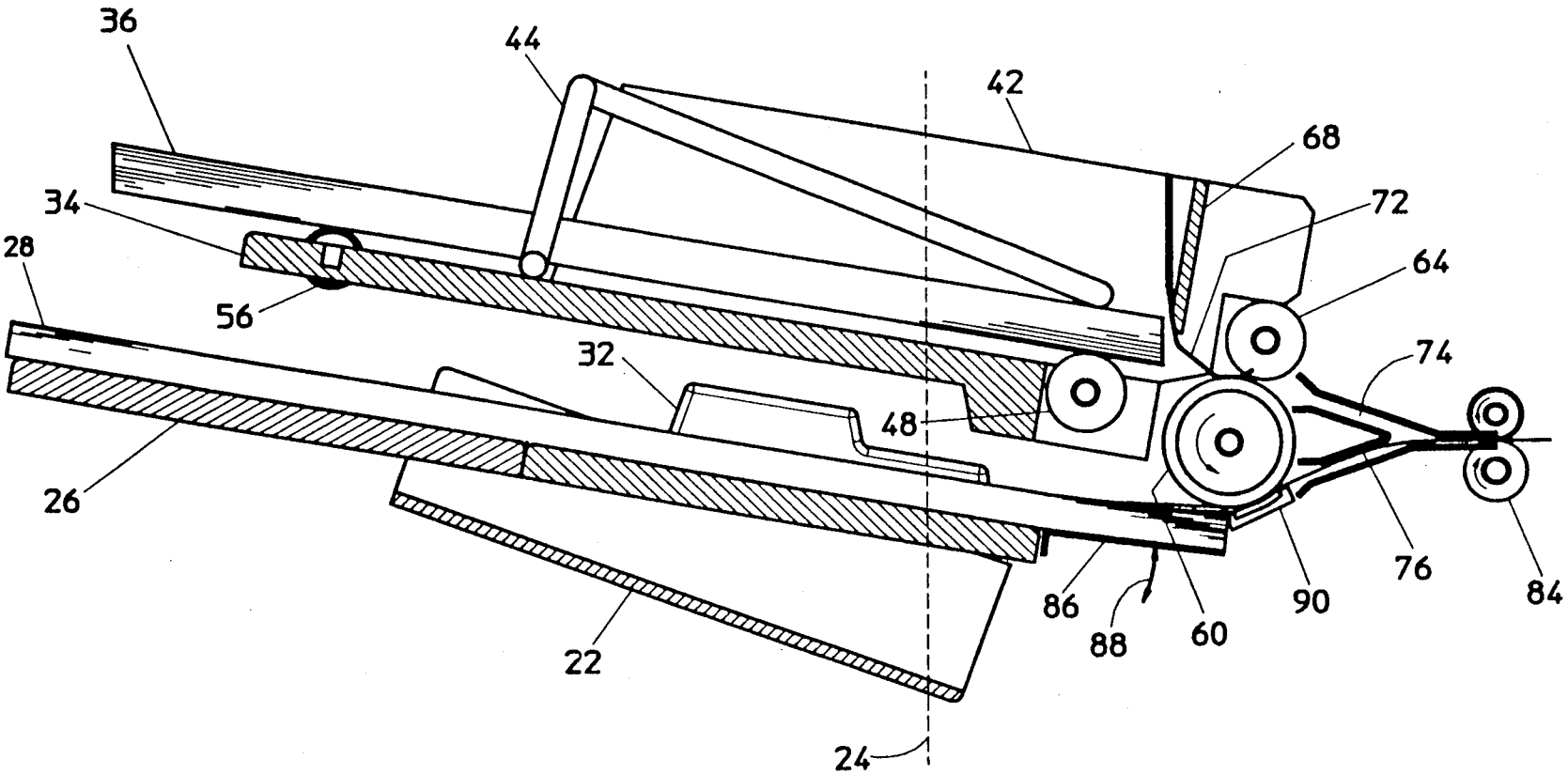
FIG. 6 is the right plan view of FIG. 5, as a paper sheet is being fed.
Figure 7:
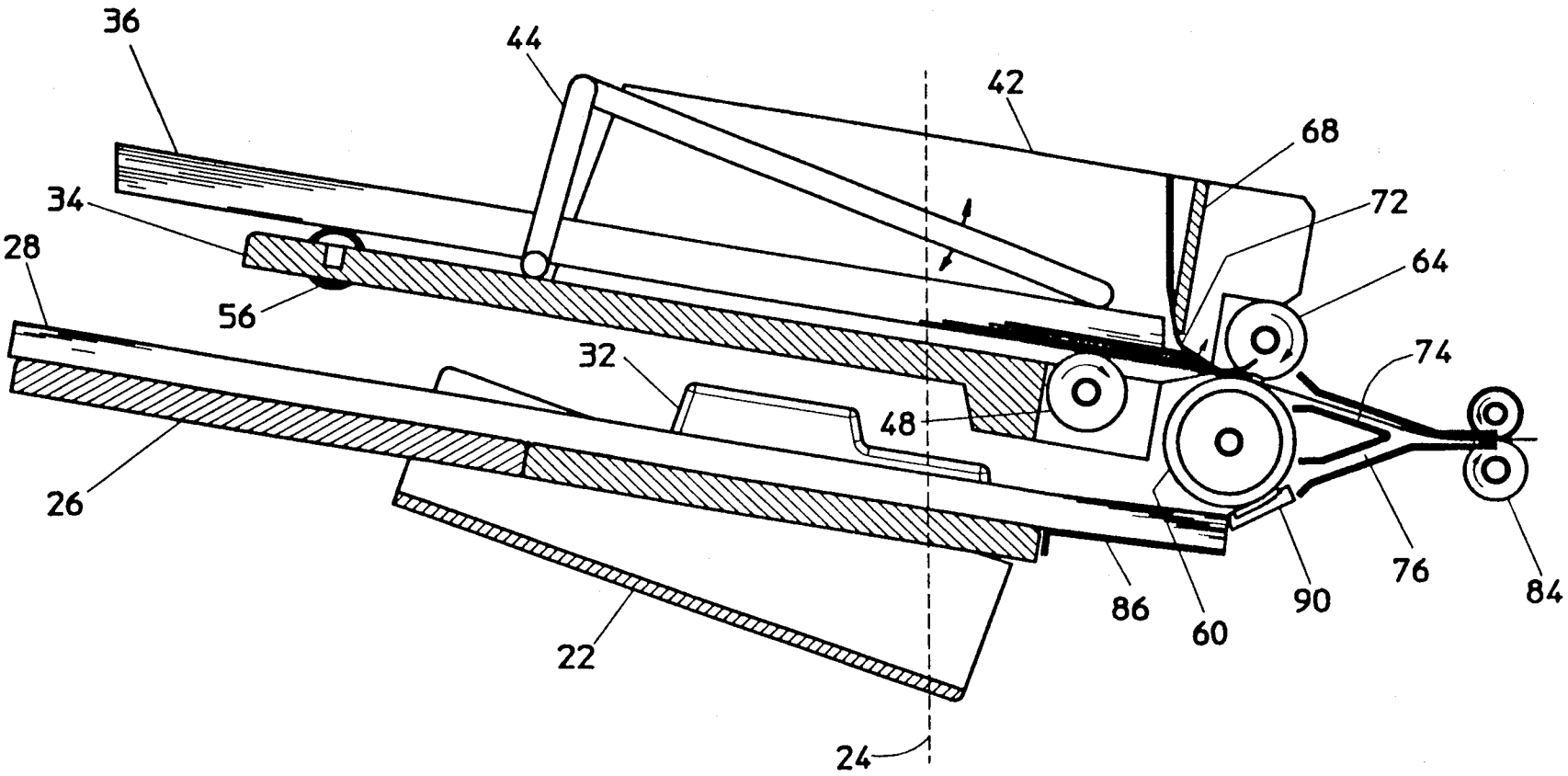
FIG. 7 is the right plan view of FIG. 5, as an envelope is being fed.

Turning now to FIGS. 5-7, a series of right plan views of both the envelope and the sheet feeder mechanisms is shown, with wall portion 42 and side guide 40 of envelope tray 34 removed and side paper guide 30 removed from paper sheet tray 26. As will be described hereinafter, when envelope tray 34 is inserted into window 24 (shown schematically by dotted line 24), feed roller 48 engages a driving mechanism which actuates it in proper time sequence.

Prior to any feeding occurring, lift plate 86 is in its retracted position, so that the topmost sheet of paper on stack 28 does not contact the outer periphery of central feed roll 60. Additionally, feed roller 48 is disconnected from its drive source and the bottommost envelope of stack 36 remains in place.

If it is now desired to feed a sheet from stack 28, (see FIG. 6), a cam moves lift plate 86 up to enable the topmost sheet on stack 28 to contact the periphery of central feed roll 60. At the same time, a drive source is connected to feed roll 60 and rotates it in the counterclockwise direction, thereby enabling it to pick up the topmost sheet from stack 28 and feed it through guide channel 76 to transport rollers 84. At the same time, as feed roller 60 is rotated counterclockwise, transport rollers 84 are rotated so as to grab any sheet coming through guide channel 76 and pass that sheet into interior print mechanisms. After the sheet has been grabbed by transport rollers 84, the cam holding up lift plate 86 is rotated so that lift plate 86 returns to its home or lowered position. This completes a single sheet feeding cycle.

When it is desired to feed an envelope into the interior of the printer mechanism (see FIG. 7), feed roller 48 is rotated in a clockwise direction to impel the lowermost envelope in stack 36 towards the nip between flexible fingers 72 and central feed roller 60. At the same time, central feed roller 60 is rotated clockwise, as is stripper roller 64. As an envelope hits flexible fingers 72, they are raised somewhat, but push the envelope into engagement with the outer frictional surface of central feed roller 60. As a result, the lowermost envelope is drawn between central feed roller 60 and stripper roller 64 and is fed into guide channel 74 and thence between transport rollers 84.

If two or more envelopes are fed, the added thickness results in the upper envelope deforming and depressing the foam surface of stripper roller 64. As a result, there is a substantial increase in the frictional forces between the periphery of stripper roller 64 and the uppermost envelope. The rotation of stripper roller 64 thus stops the uppermost envelope from proceeding into the feed mechanism.

It can thus be seen that a single central feed roll 60 is enabled to feed both sheet paper and envelopes, and that only stripper roller 64 and upper guide 78 need be added to the mechanisms within the printer case to accommodate envelopes.

Figure 8:
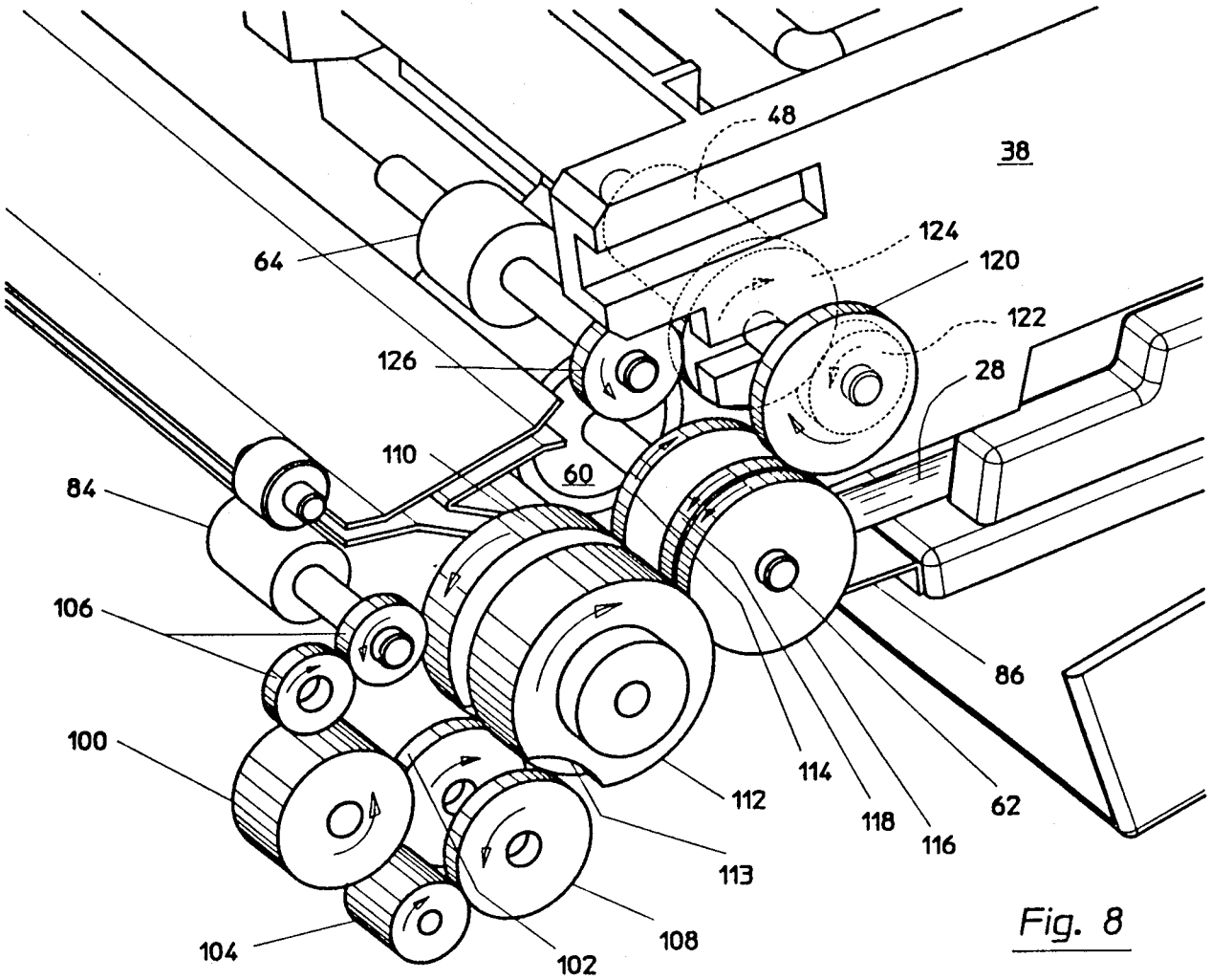
FIG. 8 is a schematic, left front perspective view of the mechanism used to drive the printer's central feed roll.
Figure 9:
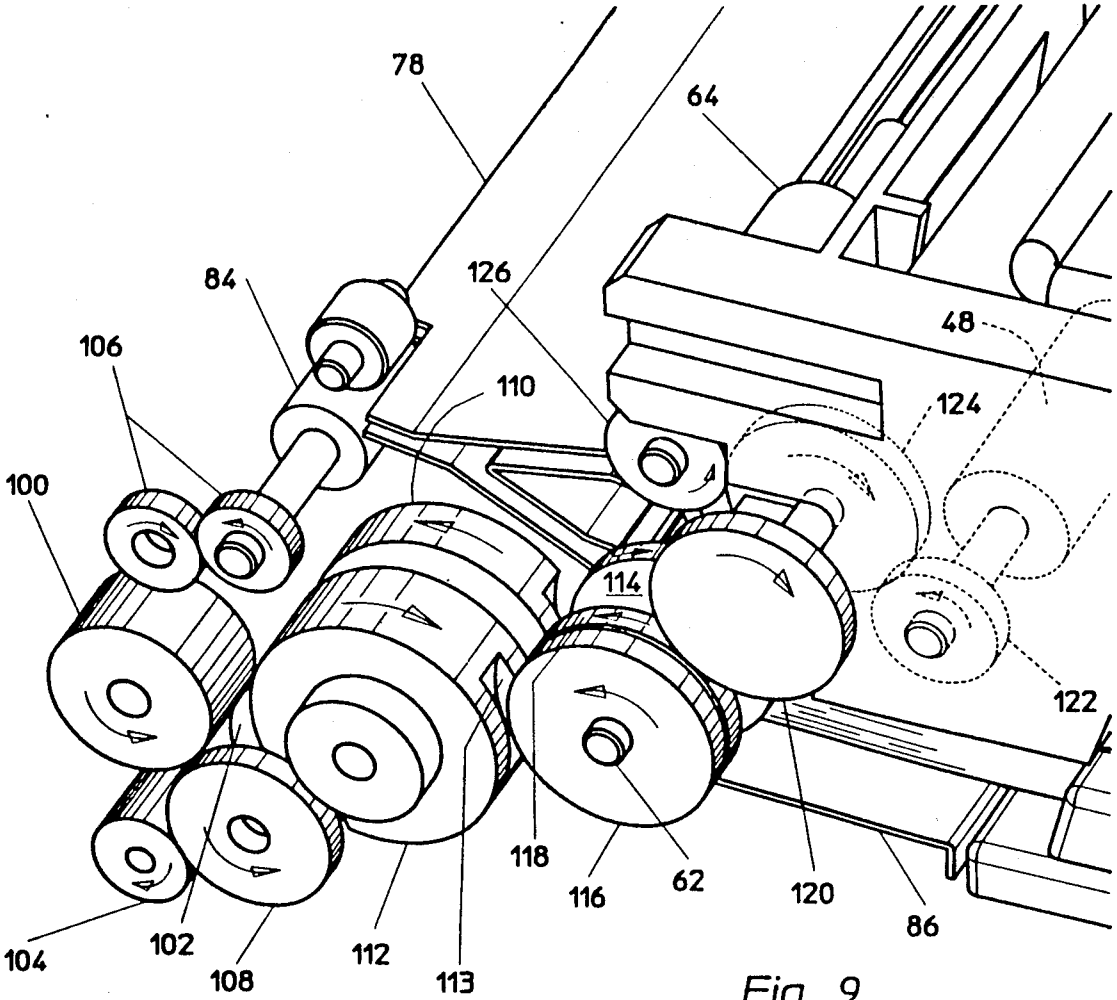
FIG. 9 is a left, rear perspective view of the mechanism of FIG. 8.

Turning now to FIGS. 8 and 9, a drive train is shown for controlling the movements of the various feed and stripper rollers. Each of the gears in FIGS. 8 and 9 is shown schematically and without teeth. The view of FIG. 8 is taken from the front left of the invention and is similar in perspective to that of FIG. 3. A drive gear 100 is connected to the main printer motor (not shown) and rotates counter clockwise while the printer is printing. Drive gear 100 drives a paper drive gear 102, a reverse idler gear 104 and transport gears 106. Reverse idler gear 104 drives envelope drive gear 108. Thus, paper drive gear 102 rotates clockwise while envelope drive gear 108 rotates counter clockwise.

A paper clutch gear 110 and an envelope clutch gear 112 are held in the positions shown, by spring detents (not illustrated). Cutouts 113 in these two gears prevent them from being driven by gears 102 and 108 while they are in this home position.

To feed a sheet of paper from stack 28, paper clutch gear 110 is bumped by a solenoid (not shown) in a counter clockwise direction out of a detent position and into contact with paper drive gear 102. Paper clutch gear 110 is thereby rotated a single rotation until cutout 113 returns to the detent position. That action drives a gear 114 which is fixed to shaft 62. The rotation of shaft 62 in a clockwise direction thereby causes central feed roll 60 to rotate in a clockwise direction and to feed a sheet of paper. When paper clutch gear 110 returns to its home detent position, gear 114 is no longer driven and is freely rotatable.

To feed an envelope from envelope tray 34, envelope clutch gear 112 is bumped by a solenoid (not shown) clockwise out of its detent position into contact with envelope drive gear 108. Envelope clutch gear 112 is rotated by gear 108 a single rotation until cutout 113 returns to the detent position. Envelope clutch gear 112 drives envelope gear 116 which is fixed to shaft 62 in a counterclockwise direction. The rotation of gear 116 causes shaft 62 to rotate central feed roll 60 in the counterclockwise direction. Simultaneously, envelope clutch gear 112 drives an idler gear 118 which, in turn, drives envelope feed gear 120 in a clockwise direction.

A perspective view of envelope feed gear 120 and its associated gearing is shown in FIG. 9. As envelope feed gear 120 rotates clockwise, it causes gear 124, which fits into envelope tray 34 when it is slid into place, to likewise rotate in a clockwise direction. That action, in turn, causes gear 122 (integral to envelope tray 34) to rotate in a counterclockwise direction and drives envelope feed roller 48 in the like direction. As a result, envelope feed roller 48 pushes a lowermost envelope towards central feed roll 60, which is now turning in a counterclockwise direction. Gear 124 also causes stripper gear 126 to rotate in a counter clockwise direction, thereby driving stripper roll 64 similarly. It is to be understood, that while feed gears 120 and 124 have been described as toothed gears, friction wheels can also be substituted therefor, if desired.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A mechanism for receiving envelopes and sheets through input window means, said mechanism comprising:

first tray means for holding a stack of sheets, said tray means mountable in said window means;

second tray means for holding a stack of envelopes, said second tray means mountable in said window means; roller means including a counter rotatable, fixed axis first feed roller positioned to selectively engage a topmost sheet on said stack in said first tray, or a bottommost envelope of said stack in said second tray, and to feed either said topmost sheet or said bottommost envelope, as the case may be; and a second feed roller positioned in said second tray means for moving said bottommost envelope into engagement with said first feed roller.

2. The mechanism as recited in claim 1 further comprising:

means for causing a sheet in said first tray means to move into contact with said first roller.

3. The mechanism as recited in claim 2, further comprising:

resilient means for biasing said bottommost envelope against said first feed roller when it is fed into engagement therewith.

4. The mechanism as recited in claim 3, wherein said first feed roller is a central feed roll, and said mechanism includes a stripper roll, said stripper roll actuatable to counter-rotate against the direction of rotation of said central feed roll when it is engaging an envelope, so as to prevent the feeding of more than a single envelope from said stack.

5. The mechanism as recited in claim 4, wherein said stripper roll has a periphery that is separated from a periphery of said central feed roll by approximately the thickness of an envelope and wherein said stripper roll has a fixed axis of rotation and exhibits a substantially pliable surface which is depressed when a second envelope attempts to feed through said separation between said stripper roll and said central feed roll, whereby depression of said stripper roll causes increased friction to be imposed on said second envelope and the rotation of said stripper roll pushes said second envelope back towards said stack.

6. The mechanism as recited in claim 4 wherein said stripper roll is covered with a spongy material having substantial pliability.

7. The mechanism as recited in claim 4 further comprising:

Y-shaped channel means having a pair of item receiving channels, one said item receiving channel communicating with the portion of said central feed roll which engages an envelope from said stack and another item receiving channel communicating with the portion of said central feed roll which engages a sheet, whereby both said sheets and envelopes are directed through a single exit of said Y-shaped channel.

8. The mechanism as recited in claim 1 further comprising:

drive means positioned in said mechanism for engaging said second drive roller in said second tray means when said second tray means is mounted in said input window means, whereby said second feed roller receives actuating power from said drive means.

9. A printer for receiving both envelopes and sheets, said printer adapted to receive both a sheet tray and an envelope tray in a window therein, said trays having distal and proximal ends, said printer comprising:

a central roller positioned in said printer at the distal ends of said trays when said trays are mounted in said window therein;

a movable platform positioned at the distal end of said sheet tray for supporting a stack of sheets which extend from said sheet tray, and for moving said supported stack into engagement with said central roller so as to enable feeding of a topmost sheet in said stack into said printer;

a feed means in said envelope tray for feeding a bottommost envelope from a stack of envelopes in said envelope tray into engagement with said central roller so as to enable feeding of said bottommost envelope into said printer; and drive means for rotating said central roller in a first direction to feed said topmost sheet into said printer, and in a reverse direction to feed said bottommost envelope into said printer.

10. The printer as recited in claim 9 wherein said central roller is positioned approximately between said sheet tray and envelope tray and engages envelopes at one position on its circumference and sheets at another position on its circumference.

11. The printer as recited in claim 9, wherein said feed means in said envelope tray is a feed roller mounted to engage the bottommost envelope of a stack of envelopes in said envelope tray.

12. The printer as recited in claim 11 wherein said feed roller includes an engagement mechanism which extends outside said envelope tray and engages a drive mechanism in said printer, when said envelope tray is positioned in said window.

13. The printer as recited in claim 10 further comprising:

a counter-rotating stripper roller whose periphery is positioned away from said one position on the circumference of said central roller by approximately the thickness of an envelope, said stripper roller having a fixed axis of rotation.

14. The printer as recited in claim 13 wherein said stripper roller exhibits a compressible and compliant frictional surface, whereby the presence of a second envelope between said stripper roller and said central roller causes said frictional surface to be compressed and to exert increased frictional engagement forces with said second envelope, so that the counter-rotation of said stripper roller returns said envelope in the direction of said stack.

15. The printer as recited in claim 14, wherein said envelope tray has a resilient spring means which engages said central roller when said envelope tray is in position in said window, said spring means biasing an envelope against said central roller as said envelope is fed.

16. The printer as recited in claim 15 wherein said envelope tray includes weighting means positioned to bear upon said stack of envelopes at a point centered above said feed roller, when said envelope tray is emplaced in said window.

17. The printer as recited in claim 16, further comprising:

a central feed channel and a pair of guide channels, said guide channels receiving envelopes and paper sheets from said central roller and feeding them into said central feed channel to engage further transport rollers.

* * * * *